United States Patent [19]

Carter et al.

[11] 4,063,485

[45] Dec. 20, 1977

[54] DECOY LAUNCHER SYSTEM

[75] Inventors: William M. Carter, Glendora; Robert W. Klauschie, Claremont; George H. Schillreff, Glendora, all of Calif.

[73] Assignee: General Dynamics Corporation, Pomona, Calif.

[21] Appl. No.: 603,498

[22] Filed: Dec. 21, 1966

[51] Int. Cl.[2] ..... F41F 3/00

[52] U.S. Cl. ..... 89/1.816; 89/1.5 R; 89/1.814

[58] Field of Search ..... 89/1, 1.816, 1.5, 1.814; 102/34.4, 35.6, 37.6

[56] References Cited

U.S. PATENT DOCUMENTS

| | | | |
|---|---|---|---|
| 1,417,500 | 5/1922 | Coley et al. | 89/1.5 A |
| 2,148,444 | 2/1939 | De Port | 89/1.5 R X |
| 2,421,893 | 6/1947 | Lambert et al. | 89/1.814 X |
| 2,961,927 | 11/1960 | Dufour | 89/1.816 |
| 3,095,814 | 7/1963 | Jansen et al. | 102/34.4 X |

*Primary Examiner*—David H. Brown

*Attorney, Agent, or Firm*—Lafayette E. Carnahan; Edward B. Johnson

[57] ABSTRACT

The disclosure broadly relates to a launcher system for providing a protective cover against homing devices operating upon infrared, sound navigation and ranging, and/or microwave-reflected energy. The launcher system is illustrated in one embodiment as a nine round portable system wherein the decoy rounds are selectively fired manually by nine pushbuttons located in the control box. The decoy rounds each contain an electric squib which simultaneously ignites both a lift charge and a time fuse. The lift charge propels the round from the launcher in a ballistic trajectory and the time fuse ignites a burst charge which disperses the payload at the optimum altitude for the type of round being used. Other embodiments of the system illustrate a ten round system which may also be utilized in multiples thereof, with the control therefor being located within the control section of a ship or the like and activated through an intervalometer. The rounds for each of the embodiments are connected to receptacles positioned intermediate the launch tubes. The squib plug, wires, and shielding braid all fly with the rounds when fired.

8 Claims, 6 Drawing Figures

INVENTORS.
WILLIAM M. CARTER,
ROBERT W. KLAUSCHIE,
GEORGE H. SCHILLREFF,

By L E Carnahan
AGENT.

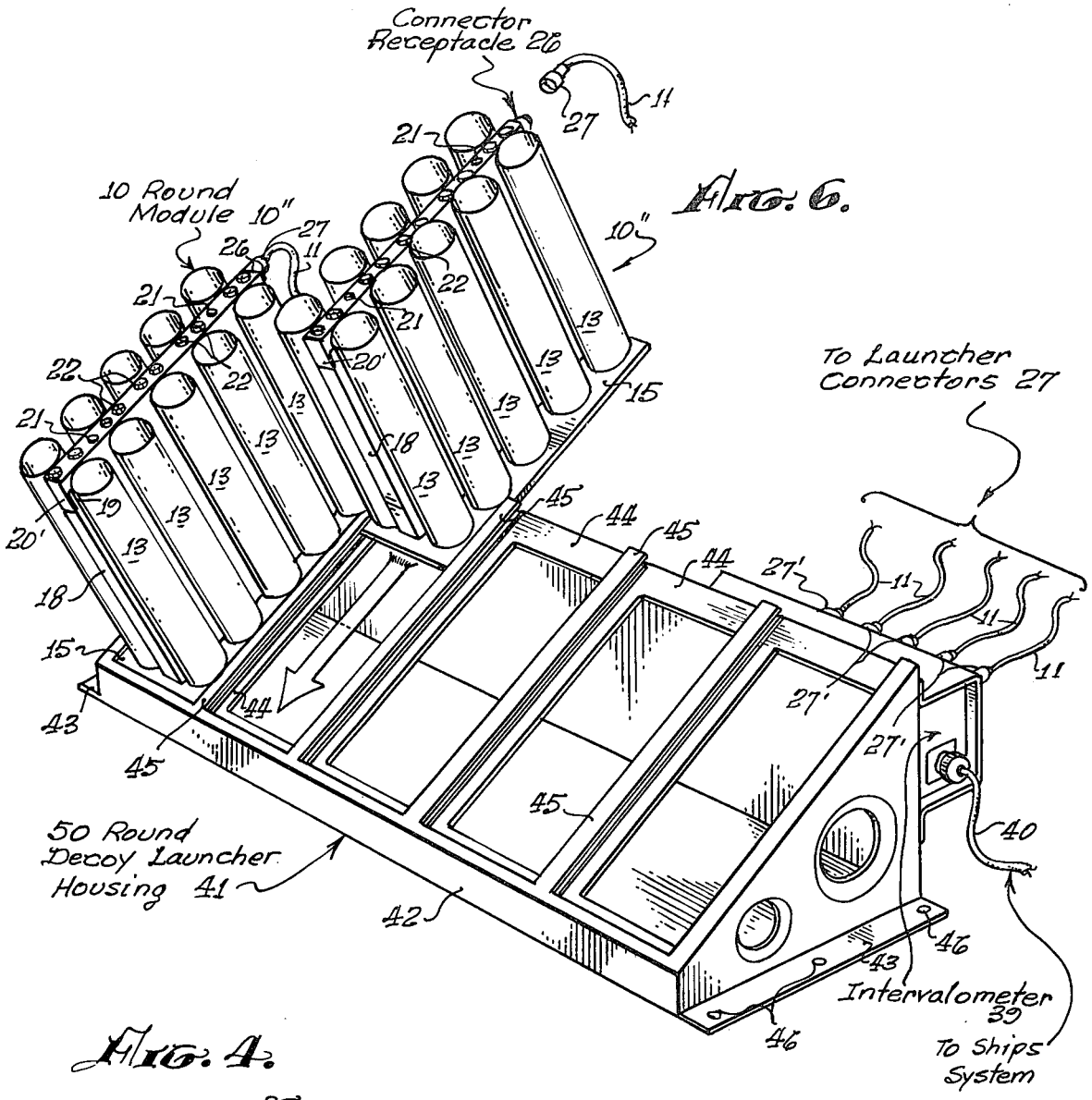
FIG. 6.
FIG. 4.
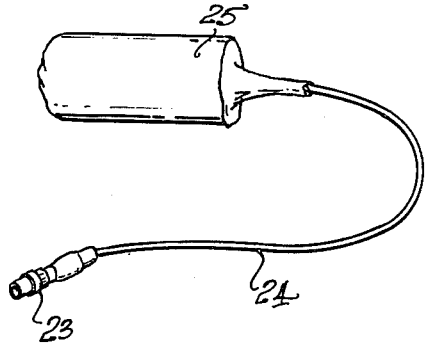
INVENTORS.
WILLIAM M. CARTER,
ROBERT W. KLAUSCHIE,
GEORGE H. SCHILLREFF,
By L E Carnahan
AGENT

INVENTORS.
WILLIAM M. CARTER,
ROBERT W. KLAUSCHIE,
GEORGE H. SCHILLREFF,

BY L E Carnahan
AGENT.

DECOY LAUNCHER SYSTEM

BACKGROUND OF THE INVENTION

This invention relates to countermeasures systems, particularly to systems for providing a protective cover against homing and/or fire control devices operating upon infrared, sound navigation and ranging, or microwave-reflected energy, and more particularly to launching systems for decoy rounds which confuse the sensing mechanism of such devices and thus decrease the effectiveness thereof.

SUMMARY OF THE INVENTION

Therefore, it is an object of this invention to provide a launcher system particularly adapted for decoy rounds.

A further object of the invention is to provide a portable decoy launcher system which is completely self-sustaining.

Another object of the invention is to provide a decoy launcher system which may be controlled by the control console of a ship or the like, upon which the launcher is positioned.

Another object of the invention is to provide a launcher system for rounds which may be utilized in multiples thereof and controlled through a single control mechanism.

Another object of the invention is to provide a simple, inexpensive, and yet effective system for dispensing dispersible decoy material for confusing sensor systems operating on infrared, sound navigation and ranging, and/or microwave-reflected energy.

Another object of the invention is to provide a decoy launcher system capable of firing individual rounds singly, in sequence, or by multiple bursts.

Another object of the invention is to provide a decoy system for low-cost, easily handled rounds, and launching equipment which provides added defense and attack support for surface ships, for example.

Other objects of the invention will become readily apparent from the following description and accompanying drawings wherein:

BRIEF DESCRIPTION OF DRAWINGS

FIG. 4 is a perspective view of a decoy round adapted for use in all of the launcher system embodiments;

FIG. 6 illustrates another embodiment of the ten round launcher unit for multiple unit application.

DESCRIPTION OF THE EMBODIMENTS

Figure 1:
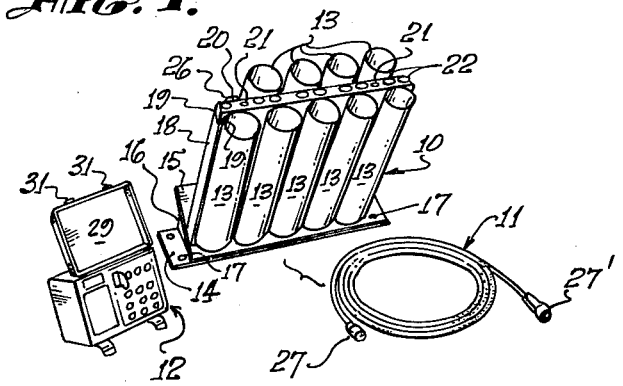
FIG. 1 is a view illustrating the basic components of an embodiment of a nine round portable launcher system made in accordance with the invention.

Referring now to the drawings, the portable decoy launcher system, as illustrated in FIGS. 1–4, consists generally of a nine tube launcher assembly 10, a firing cable 11, and a power control unit 12. The complete system can, for example, be carried aboard and set up in locations compatible with normal ship operations or can be utilized anyplace requiring a need for such a system. The launcher assembly 10 is held in place by appropriate weights such as sandbags, or likewise weighted, or may be bolted or lashed down to dampen the recoil from firing. The assembly 10 can be protected prior to firing, if desired, by a waterproof cover (not shown). Also, while not shown, caps may be positioned over each of the individual tubes 13 of the launcher assembly 10 to protect the individual rounds located therein from splash. The rounds, as illustrated in FIG. 4, are fired manually by the pushbuttons of the power control unit 12 as shown more clearly in FIG. 3 and described in detail hereinafter.

The launcher assembly 10 may be constructed of steel or other suitable material and is easily carried by one man. Assembly 10 comprises a horizontal base member 14 to which is welded or otherwise secured a tube support plate 15 to which the individual launch tubes 13 are secured by welding or the like, plate 15 being provided with angle-shaped support members 16 so as to position the plate 15 at a sixty degree (60°) angle with respect to the base member 14. The assembly 10 may, for example, be fabricated by butting 18-inch long, 3-inch ID, one-eighth inch wall tubes 13 to a one-fourth inch rectangular shaped plate 15 and then welding completely around the tubes 13 where they meet the plate 15. In the configuration illustrated in FIG. 1, there are two rows of tubes 13 with five (5) tubes on the lower row and four (4) tubes on the upper. Base member 14 is provided with apertures 17 for securing the base to a fixed support such as the deck of a ship. Fixedly secured to support plate 15, intermediate the rows of tubes 13, is a support member 18 which has a pair of flanged portions 19 at the upper end defining a channel, and a pair of threaded bores therein (not shown) for removably securing a wiring harness 20 thereto by bolts 21.

Figure 2:
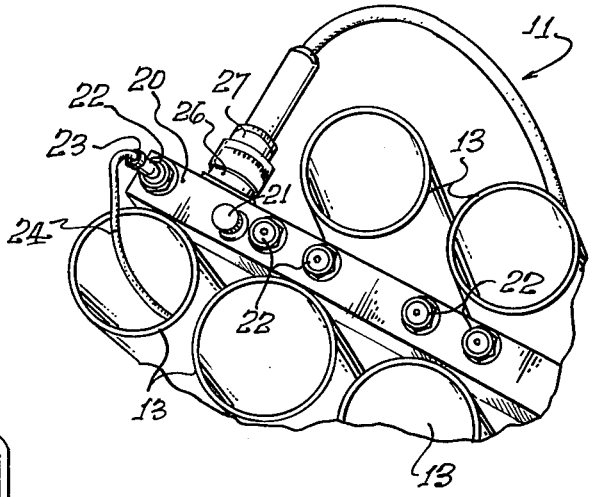
FIG. 2 is an enlarged view of a portion of the FIG. 1 embodiment illustrating the interconnection of the wiring harness with the firing cable and squib plug of a round.

Wiring harness 20 is provided with an electrical plug assembly 22 for each of the tubes 13 (nine in this embodiment), which is adapted to cooperate with a squib plug 23 (see FIG. 2) which is connected via wire 24 with a round 25 (see FIG. 4). A receptacle 26 which is adapted to receive either of quick-connect plugs 27 and 27′ of firing cable 11 (see FIG. 1), is mounted on harness 20, as shown in FIG. 2, and electrically connected to the individual plug assemblies 22. It is thus seen that the construction of the wiring harness 20 allows easy replacement or repair of the complete harness or individual elements thereof. While not shown, radiation hazard filters are contained within the body of the receptacle 26.

The firing cable 11 is waterproof and highly resistant to damage through normal use. The quick-connect plugs 27 and 27′ provide connection between the receptacle 26 of assembly 10 and the power control unit 12. The plugs 27 and 27′ are identical and the wiring is arranged so that the cable 11 is reversible. The length of the firing cable may be, for example, thirty feet so as to allow the operator to be a safe distance from the launcher assembly when firing rounds therefrom.

The power control unit 13 is mounted in a water-resistant box 28 having a cover or lid 29, with a handle (not shown), hinged at 30, box 28 being provided with fastener mechanism 31 for retaining cover 29 in the closed position. Box 28 contains the power supply, such as a standard six-volt battery, a control panel generally indicated at 32, a multi-terminal plug or receptacle (not shown) similar to receptacle 26, and the associated wiring (not shown).

Control panel 32 includes a switch 33 having SAFE and ARM positions, a switch guard 34, a red indicator light 35, a pushbotton 36 of the test circuit, a green test light 37, and pushbuttons S1–S9 corresponding to the number of round chambers or tubes 13 in launcher assembly 10. The battery is located under control panel 32 and is accessible by removing the panel. The switch guard 34 has to be down, thus throwing the switch 33 to the SAFE position, to close the cover 29 of the box 28, assuring a visible safety check when loading the tubes 13 with rounds 25.

Figure 3:
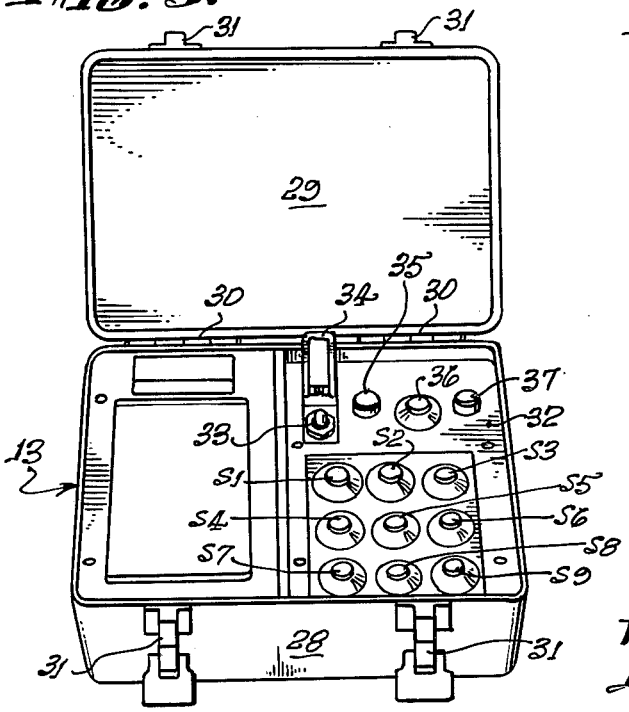
FIG. 3 is an enlarged view of the control box of the FIG. 1 embodiment illustrating the control elements therein.

The operation of the power control unit 12 is briefly as follows: (1) The cover 29 is raised by releasing fasteners 31; (2) test button 36 of the test section is pushed which illuminates green light 37 if the battery has enough power to fire the rounds; (3) the switch guard 34 is lifted, as shown in FIG. 3, and the switch 33 is thrown from the SAFE to the ARM position which illuminates red light 35 and places the system ready for firing; and (4) the rounds are fired manually by depressing the pushbuttons S1–S9 which provides an electrical impulse from the battery and ignites the launch charge in the corresponding rounds in assembly 10. If desired, the buttons S1–S9 may be arranged in a pattern similar to the arrangement of launch tubes 13. In addition, static-discharge resistors are connected to the firing circuit with the control box 28 to further safeguard the system.

The rounds 25 (see FIG. 4) may be, for example, about 2¾ inches in diameter and 9 inches in length. Plastic bags may be used to protect the rounds during shipping, storing, and firing. To use, the top of the bag (not shown) is slit and the wire 24 extended to full length and the round with plastic cover is inserted into the launch tube 13 and the squib plug 23 is inserted into the associated plug 22 as shown in FIG. 2, thereby completing the circuit from round 25 to receptacle 26. The squib body and wires are shielded by braid to minimize danger from electromagnetic radiation. The electric squibs in the rounds 25, upon activation by the power control unit 12, simultaneously ignite both a lift charge and a time fuse within the round. The lift charge propels the round from the launcher in a ballistic trajectory. The time fuse ignites a burst charge which disperses the payload at the optimum altitude for the type of round being used. Spacing of the rounds when firing depends upon the tactical situation.

The decoy rounds 25 produce targets and generate confusion in search, tracking, and homing weapons. The fast reloading capability of the launcher system provides protection both during attack or during retreat. The various types of rounds are designed to operate with respect to a ship, for example: (1) Close to the ship to confuse the ranging elements of homing weapons; (2) far enough away to minimize blast damage to the ship from weapons centered on the decoys; (3) low to appear near sea level to long distance search weapons; (4) sufficiently high to have adequate persistence for the tactical encounter; (5) deep enough to cover the distance from the surface of the water to below the first thermal layer; and (6) sufficiently large to duplicate the target size of the smallest fighting unit. Generation of larger targets to simulate larger craft may require several rounds fired at close intervals. As pointed out above, the rounds 25 may contain infrared, sound navigation and ranging, and/or microwave-reflected energy, and thus provide protection against radar, infrared, and/or underwater search, tracking, and homing weapons.

Figure 5:
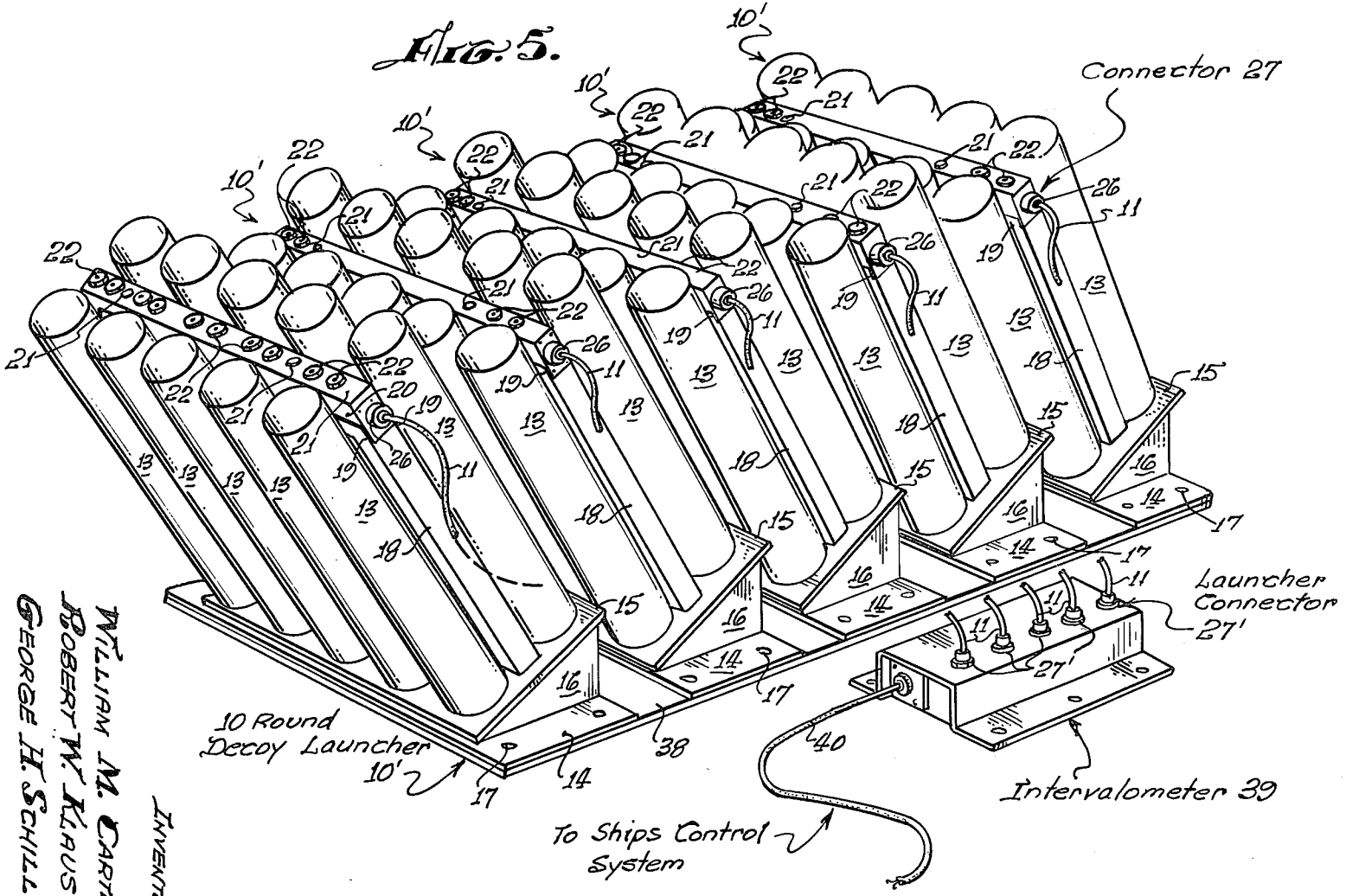
FIG. 5 illustrates an embodiment of the ten round launcher unit mounted for multiple application.

FIG. 5 illustrates a ten round embodiment of the novel launcher system in a multiple hookup for firing from the control console of a ship's control center. In the following description, like elements are given the same reference numeral as in the FIGS. 1–4 embodiment. The individual ten round launcher assembly (module) 10' is similar to the nine round launcher assembly 10 of FIG. 1 except that each of the two rows contains five (5) launch tubes 13, the wiring harness 20' is provided with an additional electrical plug assembly 22 for the added tube 13, and the receptacle 26 is positioned at the end of harness 20' for connection with a quick-connect plug 27 of firing cable 11.

As shown in FIG. 5, each of the individual launcher assemblies (modules) 10' are cascaded one behind another and all mounted on and secured to a plate 38 to form a multiple firing unit. Firing cables 11 connect each of the modules 10' with an intervalometer 39, while a cable 40 connects the intervalometer 39 with a remote firing control unit, such as the control console of a ship. The remote firing control unit (not shown) is provided with ready and reload indicating lights and means for firing the individual rounds of each module 10' or all rounds of one or more of the modules 10'. Since intervalometers are known in the art, and since the details thereof do not constitute part of the invention, further description thereof is deemed unnecessary except to state that a reloading switch which interrupts the firing circuit may be located on the intervalometer 39. Also, although not shown, covers for the modules 10' may be provided which have an interlocking switch to prevent firing when in place.

While not shown, an individual ten round launcher system may be used having its own power control unit similar to the FIGS. 1–4 embodiment, except that the control panel and firing cable are designed for ten (10) pushbuttons instead of the nine as previously illustrated. Of course, the nine round power control unit 12 could be used with the ten round launcher assembly 10' if one additional (tenth) round need not be fired. The ten round assembly could, for example, be constructed of the same material and assembled in the same manner as described above with respect to the nine round embodiment.

Also, while not shown, it is contemplated that the individual launcher assemblies or modules 10' can be assembled by modifying support structure thereof by fixedly securing the angle-shaped support members 16 to the base member 14 and adding a flanged rim across the members 16 such that the tube support plate 15 can be removably slid therein, as will be more apparent in view of the FIG. 6 embodiment and the description thereof.

While not shown in FIG. 5 for clarity, the decoy rounds are positioned in each of the tubes 13 of modules 10' and the squib wires thereof connected to the plugs 22 of wiring harness 20' in the same manner as described above with respect to the FIGS. 1–4 embodiment.

FIG. 6 illustrates a ten round embodiment of the novel launcher system in a multiple hookup for firing from a control console of a ship or the like. Elements similar to those of the FIG. 5 embodiment are given the same reference numeral. In the FIG. 6 embodiment the basic individual ten round launcher assembly or module 10'' consists of the support plate 15 with the tubes 13, support member 18 and wiring harness 20' mounted thereon as described above. The modules 10'' (only two shown) are inserted in a launcher housing or rack 41 with the intervalometer 39 mounted on the back thereof. The intervalometer is connected through cables 11 and 40 with the launcher assemblies or modules 10'' and the control unit respectively, as described above with respect to FIG. 5. The housing or rack 41 is illustrated as being of a fifty round type, which is capable of handling up to five modules 10'' but may be of any desired size. Housing 41 consists of an angled frame generally indicated at 42, support or tie-down plates 43 secured to the ends of frame 42, and launcher assembly or module support plates 44 which are positioned below the rib portions 45 of frame 42 so as to allow the tube support plate 15 of modules 10'' to slide between the ribs 45 and plates 44 as shown in FIG. 6. Tie-down plates 43 are provided with apertures 46 for securing the housing 41 to a fixed support. The FIG. 6 embodiment is fired as described above with respect to FIG. 5.

While a specific number of launch tubes 13 have been illustrated for each of the launcher modules, it is within the scope of this invention to utilize either a greater or less number and to arrange the tubes in any desired configuration. However, changes in the number or configuration of the launch tubes in the modules would require a corresponding change in the number of electrical plugs, wiring, and control buttons.

It has thus been shown that this invention provides an inexpensive yet effective launcher system especially adapted for decoy rounds, the system being so constructed that it can be readily adapted to various configurations and for various applications due to the "module" type construction.

Although particular embodiments of the invention have been illustrated and described, modifications and changes will become apparent to those skilled in the art, and it is intended to cover in the appended claims all such modifications as come within the true spirit and scope of the invention.

What we claim is:

1. A launcher assembly comprising: a tube support plate means, a vertical support member fixedly attached at one end thereof to the upper surface of said tube support plate means and extending at substantially a right angle therefrom, a plurality of tubes mounted in a plurality of rows upon said tube support plate means and extending upward along said vertical support member, at least one of said rows being adjacent at least one of the opposing sides of said vertical support member, said tubes functioning for storage of associated rounds and as the launch base for firing of associated rounds, electrical harness assembly means secured to said vertical support member at the end thereof opposite said tube support plate means and adapted for connection with associated rounds, an angularly configured base assembly, said tube support plate means being mounted on said base assembly so as to position said tube support plate means at an angle with respect to a vertical axis of said base assembly, said base assembly including base plate means and angularly configured plate means fixedly attached to said base plate means and to the lower surface of said tube support plate means, said base plate means additionally including a portion adapted for securing same to a fixed support.

2. The launcher assembly defined in claim 1, in combination with a power supply; control apparatus for said power supply, said power supply and said control apparatus being positioned within a portable container and remotely located from said tube support plate means; and electrical cable and connector means interconnecting said harness means with said control apparatus, whereby associated rounds may be launched from said tubes individually, sequentially or in salvo.

3. The launcher assembly defined in Claim 1, in combination with rounds by suitable decoy material positioned in at least a portion of said tubes, said rounds being electrically connected to said electrical harness assembly means.

4. A portable launcher system comprising: a horizontal base plate, a tube support plate having one edge adjacent to said base plate, at least one triangular support member attached to said base plate and adjacent said tube support plate to position said tube support plate at an angle to said horizontal base plate, said tube support plate being secured to at least one of said triangular support members and to said base plate, a vertical support member fixedly attached at one end thereof to the upper surface of said tube support plate and extending at substantially a right angle therefrom, said vertical support member defining a channel at the opposite end thereof, a plurality of tubes mounted upon said tube support plate and extending upward along said vertical support member, certain of said plurality of tubes being positioned on opposite sides of said vertical support member, said tubes functioning for storage of associated rounds and as the launch base for firing of associated rounds, an electrical wiring harness assembly mounted in said channel of said vertical support member and adapted for connection with associated rounds, said harness assembly including a plurality of plug-like means adapted to be connected with electrical wiring of associated rounds positioned in said tubes, a power supply, control apparatus for said power supply, said power supply and said control apparatus being positioned within a portable container and remotely located from said horizontal base plate, and reversible electrical cable means and electrical connector means interconnecting said electrical wiring harness assembly with said control apparatus, said electrical connector means including receptacle means mounted on said harness assembly and connected with said plug-like means, whereby associated rounds may be launched from said plurality of tubes individually, sequentially or in salvo.

5. The launcher assembly defined in claim 4, in combination with rounds of suitable decoy material positioned in at least a portion of said tubes, said rounds being electrically connected to said plug-like means of said harness assembly.

6. A launcher assembly comprising: a tube support plate means, a vertical support member fixedly attached at one end thereof to the upper surface of said tube support plate means and extending at substantially a right angle therefrom, a plurality of tubes mounted in a plurality of rows upon said tube support plate means and extending upward along said vertical support member, at least one of said rows being adjacent at least one of the opposing sides of said vertical support member, said tubes functioning for storage of associated rounds and as the launch base for firing of associated rounds, electrical harness assembly means secured to said vertical support member at the end thereof opposite said tube support plate means and adapted for connection with associated rounds, an angularly configured base assembly, said base assembly including at least one angular frame member fixedly attached to a tie down plate means, assembly support plate means fixedly attached to said angular frame members such that said assembly support plate means defines an angle with respect to said tie down plate means, rib portion means secured to said assembly support plate means and with said angular frame member, said tube support plate means being removably positioned intermediate said rib portion means and said assembly support plate means, whereby said tube support plate means and said tubes secured thereto are positioned at an angle with respect to said tie down plane means of said base assembly.

7. The launcher assembly defined in claim 6, in combination with a power supply; control apparatus for said power supply; said power supply and said control apparatus being positioned within a portable container and remotely located from said tube support plate means; and electrical cable and connector means interconnecting said harness assembly means with said control apparatus, whereby associated rounds may be launched from said tubes individually, sequentially or in salvo.

8. The launcher assembly defined in Claim 6, in combination with rounds of suitable decoy material positioned in at least a portion of said tubes, said rounds being electrically connected to said electrical harness assembly means.

* * * * *